US009969073B2

(12) United States Patent
Ontl et al.

(10) Patent No.: US 9,969,073 B2
(45) Date of Patent: May 15, 2018

(54) POWER TOOL

(71) Applicant: Hilti Aktiengesellschaft, Schaan (LI)

(72) Inventors: Rainer Ontl, Landsberg am Lech (DE); Damir Cehajic, Durach (DE); Christoph Dieing, Isny (DE); Christian Rehekampff, Kaufering (DE)

(73) Assignee: Hilti Aktiengesellschaft, Schaan (LI)

( * ) Notice: Subject to any disclaimer, the term of this patent is extended or adjusted under 35 U.S.C. 154(b) by 411 days.

(21) Appl. No.: 14/443,038

(22) PCT Filed: Nov. 12, 2013

(86) PCT No.: PCT/EP2013/073572

§ 371 (c)(1),
(2) Date: May 14, 2015

(87) PCT Pub. No.: WO2014/076057

PCT Pub. Date: May 22, 2014

(65) Prior Publication Data

US 2015/0290789 A1 Oct. 15, 2015

(30) Foreign Application Priority Data

Nov. 15, 2012 (DE) ..... 10 2012 220 886

(51) Int. Cl.
*B25D 17/06* (2006.01)
*B25D 11/00* (2006.01)

(52) U.S. Cl.
CPC ..... *B25D 17/06* (2013.01); *B25D 11/005* (2013.01); *B25D 2217/0019* (2013.01);
(Continued)

(58) Field of Classification Search
CPC ..... B25D 17/06; B25D 11/005
(Continued)

(56) References Cited

U.S. PATENT DOCUMENTS 4,290,492 A * 9/1981 Sides ..... B25D 11/005 173/118
5,036,925 A * 8/1991 Wache ..... B25D 11/005 173/104

(Continued)

FOREIGN PATENT DOCUMENTS

CH 662 978 A5 11/1987
DE 41 11 127 A1 10/1991

(Continued)

OTHER PUBLICATIONS

International Search Report dated Jan. 23, 2014 (Two (2) pages).
German Office Action dated Jun. 13, 2013 (Three (3) pages).

*Primary Examiner* — Nathaniel Chukwurah
(74) *Attorney, Agent, or Firm* — Crowell & Moring LLP

(57) ABSTRACT

A hand-held power tool is disclosed. The tool has a tool receptacle for holding a chiseling tool. A pneumatic percussion mechanism of the hand-held power tool includes a striker, an exciter and a guide tube. The striker is designed to apply impacts in the impact direction to the tool. The exciter is motor-driven. The striker is coupled by an air spring to the reciprocating movement of the exciter. The striker abutting the guide tube is guided along a working axis. During a movement between an impact position and the exciter, the striker is guided with a constant guide length on the guide tube and if the impact position is exceeded in the impact direction, the guide length is reduced. The hand-held power tool is equipped with an inclined guide, which inclines the striker relative to the working axis when the impact position is exceeded.

5 Claims, 3 Drawing Sheets

(52) U.S. Cl.
CPC ..... *B25D 2217/0023* (2013.01); *B25D 2250/131* (2013.01); *B25D 2250/191* (2013.01); *B25D 2250/245* (2013.01)

(58) Field of Classification Search
USPC ..... 173/204, 104, 109
See application file for complete search history.

(56) References Cited

U.S. PATENT DOCUMENTS

| | | | | |
|---|---|---|---|---|
| 5,050,687 | A * | 9/1991 | Prokhorov | B25D 9/04 173/104 |
| 5,099,926 | A * | 3/1992 | Fushiya | B25D 11/005 173/17 |
| 5,111,890 | A | 5/1992 | Ranger et al. | |
| 2003/0083186 | A1 * | 5/2003 | Hetcher | B25D 11/005 493/464 |

FOREIGN PATENT DOCUMENTS

| | | | |
|---|---|---|---|
| DE | 10 2008 000 727 | A1 | 9/2009 |
| DE | 10 2008 040 118 | A1 | 1/2010 |
| GB | 2 458 523 | A | 9/2009 |

* cited by examiner

POWER TOOL

This application claims the priority of International Application No. PCT/EP2013/073572, filed Nov. 12, 2013, and German Patent Document No. 10 2012 220 886.0, filed Nov. 15, 2012, the disclosures of which are expressly incorporated by reference herein.

BACKGROUND AND SUMMARY OF THE INVENTION

This invention relates to a hand-held chiselling power tool as is known from U.S. Pat. No. 5,111,890, for example. A pneumatic percussion mechanism has an exciter piston, which is driven in permanent reciprocal movement along an axis. An air spring couples a striker configured as a piston to the exciter piston movement. The percussion mechanism is designed to switch off if the striker travels into a stop instead of striking an intermediate striker. Venting ports are provided for this, which are released by the striker when it is adjacent to the stop. The air spring is vented via the venting ports and thereby deactivated. As soon as the striker is again pushed across the venting ports, the percussion mechanism starts to strike again. Simply by recoiling from the stop, the striker can slide back across the venting ports sufficiently to close them. In this case, there is disadvantageously no automatic deactivation of the percussion mechanism.

The hand-held power tool according to the invention has a tool receptacle for mounting a chiseling tool. A pneumatic percussion mechanism in the hand-held power tool has a striker, an exciter and a guide tube. The striker is configured on the tool for applying impacts in the impact direction. The exciter is motor-driven. The striker is coupled by means of an air spring to the reciprocal movement of the exciter. The striker adjacent to the guide tube is guided along a working axis. The striker is guided during a movement between an impact position and the exciter with a constant guide length on the guide tube, and the guide length is reduced if the impact position is overrun in the impact direction. The hand-held power tool is provided with an inclined guide which inclines the striker relative to the working axis if the impact position is overrun.

During operation, the striker flies in the impact direction to the impact position and there strikes the tool or an intermediate striker (riveting die). If the user is not working with the hand-held power tool, i.e. the tool is not pressing on a substrate, the striker can slide beyond the impact position.

The axial guiding of the striker is deliberately reduced to activate the striker into an inclined position relative to the working axis. The inclined position can encourage the striker to come to rest in order to promote the switching off of the percussion mechanism. The striker travels into the inclined guide only after overrunning the impact position. The striker reaches the inclined guide not later than after an axial impact. The striker, which is normally guided carefully in a coaxial direction relative to the working axis during operation, is deliberately inclined. The inclining hinders the movement of the striker and promotes a resting position for switching off the percussion mechanism, e.g. behind the venting ports.

An embodiment envisages that venting ports are provided for venting the air spring. The venting ports are arranged in such a way that the striker shuts off the air spring opposite the venting ports when the striker is in the impact direction before the impact position, and otherwise releases the venting ports. The air springs can thus be preferably vented as soon as the striker slides beyond the impact position.

The inclined guide can have a radial bearing surface facing the working axis and the striker can have a radial sliding surface in contact with the bearing surface. One, preferably exactly one, of the bearing surface or sliding surface is configured asymmetrically to the working axis. The inclined guide effectuates a resulting force in an angular direction on the striker, the force not being balanced due to the lack of revolving symmetry. Consequently, the striker inclines. The striker is thereby advantageously guided in the guide tube with its rear end in the impact direction.

The bearing surface or the sliding surface can have a projection protruding in a radial direction in only one angular direction. An axis of the bearing surface or an axis of the gliding surface can be offset parallel to the working axis or inclined relative to the working axis.

The striker can have a piston and a push rod. The piston seals the pneumatic chamber in the guide tube and is positively driven by the guide tube. The push rod is downstream of the piston in the impact direction and forms the impact surface, which impacts on the intermediate striker or the tool. The push rod can have a smaller diameter than the piston and is preferably not guided by the guide tube. The inclined guide guides the push rod provided the striker is advanced across the impact position.

The division of striker into piston and push rod can only be understood in terms of its function and geometry. Piston and striker are a monolithic body; piston and striker cannot be separated from each other or pushed towards each other.

The push rod can have a radial surface configured asymmetrically to the axis of the piston. A midpoint in the contour of the radial surface does not lie on the axis.

Further features and advantages of the invention will emerge from the following description of exemplary embodiments shown in the accompanying drawings.

DETAILED DESCRIPTION OF THE DRAWINGS

Figure 1:
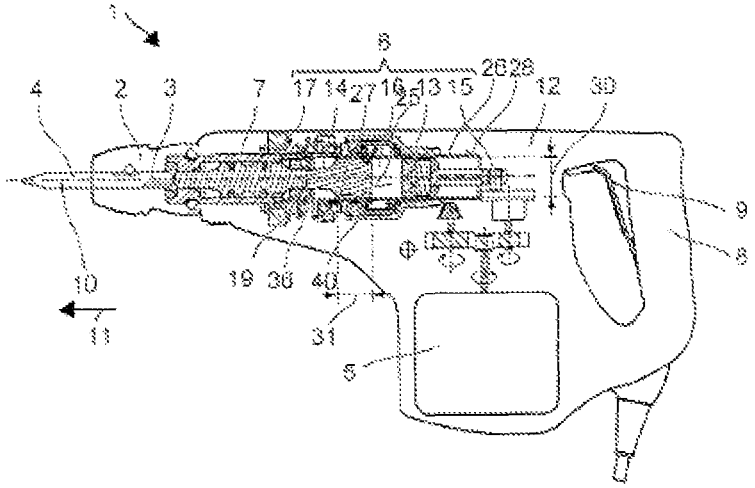
FIG. 1 is a hammer drill in impact position.
Figure 2:
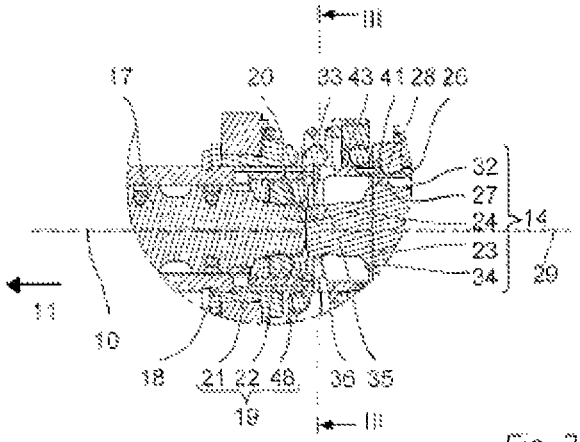
FIG. 2 is a detailed view of FIG. 1.

Identical or functionally-identical elements are indicated in the figures by the same reference numerals unless indicated otherwise.

FIG. 1 shows schematically a hammer drill 1 as an example of a hand-held chiseling power tool. The hammer drill 1 has a tool receptacle 2, into which a shaft end 3 of a tool, e.g. that of a drill bit 4, can be inserted.

A motor 5 forms a primary drive of the hammer drill 1, the motor driving a percussion mechanism 6 and a driving shaft 7. A user can guide the hammer drill 1 by means of a handle 8 and can operate the hammer drill 1 by means of a processor switch 9. During operation, the hammer drill 1 continuously rotates the drill bit 4 about a working axis 10 and can thereby impact the drill bit 4 in the impact direction 11 along the working axis 10 into a substrate. The percussion mechanism 6 and preferably the additional drive components are arranged within a machine housing 12.

The percussion mechanism 6 is a motor-driven, pneumatic percussion mechanism 6. An exciter 13 and a striker 14 are movably guided in the percussion mechanism 6 along the working axis 10. The exciter 13 is coupled to the motor 5 via an eccentric 15 or a wobble finger and forced into a periodic, linear movement along the working axis 10. An air spring formed by a pneumatic chamber 16 between exciter 13 and striker 14 couples a movement of the striker 14 to the movement of the exciter 13. The striker 14 can impact directly on a rear end of the drill bit 4 or indirectly transmit part of its impulse to the drill bit 4 via an essentially resting intermediate striker 17.

When dismantling a wall or a substrate, i.e. during operation, the user or the weight of the hammer drill 1 presses the drill bit 4 and the intermediate striker 17 against the impact direction 11 to a stop 18. The operating position of the drill bit 4 and of the intermediate striker 17 is hereby defined before the impact. The striker 14 thus hits the intermediate striker 17 in a defined position (hereinafter impact position, FIG. 1) along the working axis 10. During operation, the striker 14 moves in the impact direction 11 only up to the impact position. The movement of the striker 14 against the impact direction 11 is limited by the air spring and the exciter 13.

The stop 18 is, for example, formed by a circular bumper 19, which is arranged between the striker 14 and the intermediate striker 17. The bumper 19, particularly the hollow space, is preferably configured rotationally symmetrically and coaxially to the working axis 10. The intermediate striker 17 guided coaxially to the working axis 10 can brace itself against the impact direction 11 on the bumper 19 for the impact position. The rear end of the intermediate striker 17 with the impact surface 20 thereby preferably enters the hollow space in the bumper 19, for example, the impact surface 20 reaches at least the front face of the bumper 19 in the impact direction 11. The bumper 19 preferably includes an axially movable metal ring 21, which abuts a flexible rubber ring 22 against the impact direction 11 to dampen the rebound of the intermediate striker 17.

Figure 3:
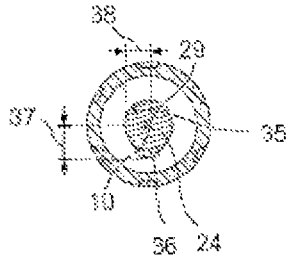
FIG. 3 is a cross-section in III-III plane of FIG. 2.

The user can end the operation by removing the tool from the wall or the substrate. The percussion mechanism 6 is intended to automatically switch off as impacts must now no longer be initiated on the drill bit 4 into the wall but be captured by the tool receptacle 2. The striker 14 is uncoupled from the exciter 13 by venting the pneumatic chamber 16. The motor 5 can thereby continue to turn without creating impacts. The hammer drill 1 automatically goes into idle operation. With the tool 4 removed, the striker 14 can slide beyond the impact position in the impact direction 11, the now adopted position (e.g. FIG. 3) being described as idle position. Venting the pneumatic chamber 16 is coupled to adopting the idle position so the striker 14 must remain in the idle position if possible when the tool 4 is removed.

The exemplary striker 14 consists of a piston 23 and a push rod 24. By means of an end face 25, the piston 23 pressure seals the pneumatic chamber 16 in the impact direction 11. During operation, the striker 14 is forcibly guided through a guide tube 26 coaxially to the working axis 10. Guiding is through a lateral surface 27 of the piston 23, which is flush with a cylindrical, inner guide surface 28 of the guide tube 26. The axis 29 of the piston 23, which defines the axis of the striker 14, lies on the working axis 10. A diameter 30 of the piston 23 is equal to the inner diameter of the guide surface 28 apart from a small amount of play for the slide movement. The play is typically less than 0.1 mm. The ratio of the guided length 31 (measured along the working axis 10) of the lateral surface 27 to diameter 30 of the piston 23 counteracts an inclining of the striker 14 relative to the guide surface 28. The guided length 31 or guide length is preferably at least one quarter, e.g. at least half, of the diameter 30. The lateral surface 27 can be interrupted along the working axis 10 by grooves 32 or other structures, as in the striker 14 shown. Of importance to the guide length 31 are the surface sections distanced as far as possible from each other along the working axis 10, the sections lying on the cylinder which is pressed against the striker 14, i.e. on the guide surface 28.

The impact surface 33 of the striker 14 is adapted to the diameter of the tool 4 and is typically smaller than the diameter 30 of the striker 14 and its end face 25 which seals the air spring. An annular shoulder 34 forms a transition from the piston 23 to the push rod 24.

The push rod 24 is essentially a cylindrical body which is coaxial to the axis 29 of the piston 23. The body forms the main part of the radial surface 35 of the push rod 24. One or several annular grooves can be inserted into the body. The end face of the push rod 24 forms the impact surface 33, which lies perpendicularly on the axis 29. The impact surface 33 is preferably rotationally symmetrical and coaxial to the axis 29. During impact, i.e. in impact position, the impact surface 33 lies centered on the working axis 10. The impact can be introduced into the intermediate striker 17 with minimum losses and with minimum transverse and radial forces. The intermediate striker 17 preferably also has an impact surface 20 coaxial and perpendicular to the working axis 10.

The radial surface 35 of the push rod 24 is configured asymmetrically to the working axis 10. A tooth 36 protrudes radially in a single angular direction in the push rod 24 shown by way of example and in exaggerated form in cross-section in FIG. 3. Due to the lack of a further tooth at 180 degrees, two further teeth at 120 degrees and 240 degrees or one larger tooth arranged at equidistant angles, the radial surface 35 lacks revolving symmetry. However, the impact surface 33 impacting on the intermediate striker 17 is rotationally symmetrical or has at least revolving symmetry. By way of example, the end face of the push rod 24 is slightly larger than the impact surface 20 of the intermediate striker 17, whereby the tooth 36 does not influence the impact surface 33.

The height 37, measured to the axis 29 of the striker 14, of the tooth 36 can be up to 5-20% greater than the outer radius 38 of the push rod 24. The outer radius 38 is the radial measurement of the essentially cylindrical body, e.g. the distance between the radial surface 35 and the axis 29 on the other side from the tooth 36.

The push rod 24 can be provided with several teeth without the teeth conferring a revolving symmetry to the push rod 24. For example, no tooth is provided over an angle area of at least 180 degrees around the working axis 10. A cross-section perpendicular to the axis 29 through the push rod 24 shows a surface whose midpoint or center of gravity lies outside the axis 29.

Figure 4:
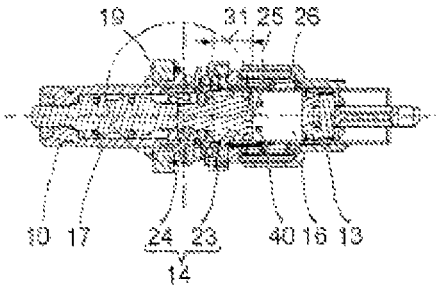
FIG. 4 is the hammer drill in idle position.
Figure 5:
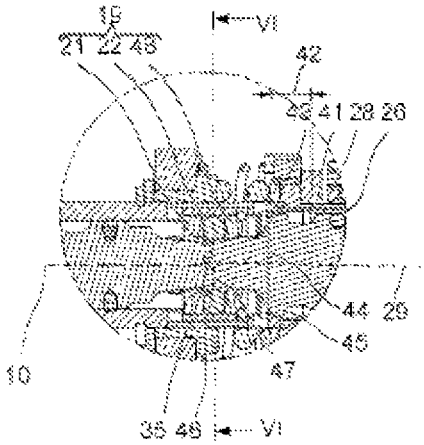
FIG. 5 is a detailed view of FIG. 4.

The idle operation is achieved through radial venting ports 40, which are only opened when the striker 14 slides in the impact direction 11 beyond the impact position into the idle position (FIG. 4). In the exemplary embodiment shown, the venting ports 40 are blocked or opened by the end face 25 of the striker 14, the end face sealing the pneumatic chamber 16. When the striker 14 is in the impact position, the end face 25 lies just in front of the venting ports 40, and when the striker 14 is in the idle position, the end face 25 lies in the impact direction 11 behind the venting ports 40.

At least a large proportion of the air moved by the exciter 13 in the pneumatic chamber 16 can flow in and out via the venting ports 40. The exciter 13 can no longer draw in the striker 14, whereby the striker remains in a position beyond the impact position.

The tight forcible guiding of the striker 14 through the guide tube 26 is limited to operation. The guide surface 28 terminates essentially on the far side of the impact position. An edge 41 of the guide surface 28 is approximately at the axial position of the edge of the lateral surface 27 for the striker 14 located in the impact position. The piston 23 and its lateral surface 27 extend beyond the guide surface 28 in the impact direction 11 when the striker 14 over-travels the impact position and finds itself in the idle position. In this arrangement, the guide length 31 shortens itself at least by the distance 42 by which the striker 14 has over-travelled the impact position. The inner surface 43 adjacent to the guide surface 28 in the impact direction 11 has a larger diameter 44 than the piston 23. The diameter is preferably increased by at least 0.5 mm and preferably by a maximum of 5 mm. The protruding part of the lateral surface 27 is therefore not guided or guided with considerably greater play. The striker 14 can incline relative to the working axis 10.

The striker 14 can preferably jut out in the impact direction 11 at least as far beyond the impact position that the lateral surface 27 abuts the guide surface 28 with less than half of its length 31. By way of example, the striker 14 can move beyond the impact position in the impact direction 11 by at least half the guide length 31, i.e. the length 31 of the lateral surface 27. In the exemplary piston 23 shown, a small distance 42 is already adequate. The groove 32 arranged approximately in the center of the lateral surface 27 divides the lateral surface 27 into a front section and a rear section 45. The piston 23 only has to be offset by a distance 42 equal to the length of the rear section 45 to reduce the guide as desired.

The striker 14 is stopped in the impact direction 11 by the bumper 19. The annular shoulder 34 of the striker 14 is braced against the bumper 19. The push rod 24 dips into the hollow space, thereby optionally pushing the intermediate striker 17 out of the hollow space. The striker 14 cannot fully exit guide surface 28 due to the bumper 19, preferably at least one tenth of the length 31 of the lateral surface 27 remains abutting the guide surface 28.

The striker 14 can be securely pushed back into the impact position by the intermediate striker 17.

The push rod 24 is unguided during operation. The striker 14 is coaxially aligned only by guiding the piston 23 on the guide surface 28 of the guide tube 26. When in idle impact position, at least when the striker 14 is abutting the bumper 19, the push rod 24 is also guided. In contrast to the piston 23, the push rod 24 is guided on a path tilted towards to the working axis 10. The sloping guide is effected by the radial surface 35 of the push rod 24, the surface sliding on the inner surface 46 of the annular bumper 19. The exemplary cylindrical inner surface 46 is coaxial to the working axis 10. At least the section protruding asymmetrically in the radial direction, e.g. the tooth 36, is guided through the inner surface 46. The tooth 36 has a height 37, which is measured in a radial direction from the axis 29 of the striker 14. The height 37 is somewhat greater than an inner radius 47 of the inner surface 46. The push rod 24 is offset perpendicular to the axis 29 corresponding to the difference in height 37 from the inner radius 47. The striker 14 still partially lying in the guide tube 26 inclines relative to the working axis 10.

Figure 6:
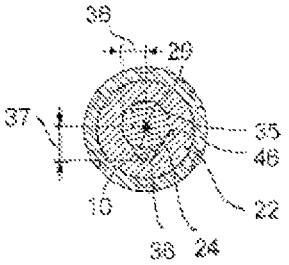
FIG. 6 is a cross-section in VI-VI plane of FIG. 5.

During idle impact position, the push rod 24 can be guided along a rigid, inflexible inner surface 46 of the bumper 19. The inner surface 46 can be configured, for example, by a steel ring 48 of the bumper 19. In this arrangement, the inner radius 47 is at least as big as the average of the height 37 of the tooth 36 and of the outer radius 38. In the exemplary embodiment shown, the elastic rubber ring 21 forms at least a part of or the whole inner surface 46. The inner radius 47 can be smaller than the average of the height 37 of the tooth 36 and of the outer radius 38 of the push rod 24. The rubber ring is more strongly squeezed by the tooth 36 in a radial direction than in the diametrically opposite angular direction (see FIG. 6). This results in a force which deflects the push rod 24 into the diametrically opposite angular direction and inclines the striker 14 relative to the working axis 10.

Figure 7:
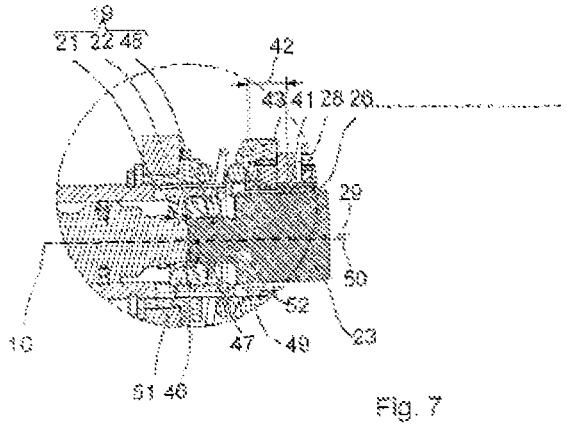
FIG. 7 is an exemplary striker of the hammer drill.

A further embodiment of the percussion mechanism 6 has a striker 14 according to FIG. 7. The piston 23 defines the axis 29 of the striker 14 and ensures its forcible guiding in the guide tube 26 coaxially to the working axis 10. The push rod 49 is an essentially cylindrical body, whose longitudinal axis 50 is inclined relative to the axis 29 of the striker 14 in order to effectuate an asymmetry in its radial surface 51 relative to the working axis 10. The bumper 19 is configured coaxially and symmetrically to the working axis 10. The inner radius 47 of the bumper 19 is selected such that the radial surface 51 of the push rod 24 abuts the inner surface 46. An outer radius 52 of the push rod 49 is, for example, equal or somewhat greater than the inner radius 47. The inclining results from the inclined longitudinal axis 50 of the push rod 49.

The part of the end face 25 forming the impact surface 33 is preferably configured perpendicular and coaxial to the axis 29 of the striker 14. The impact of the striker 14 is thus applied centrally on the working axis 10. By way of example, the end face is elliptical and the smaller radius is equal to the radius of the circular impact surface 33.

Figure 8:
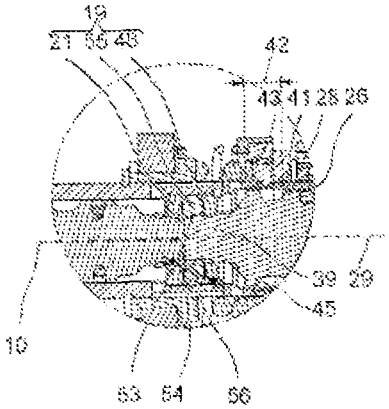
FIG. 8 is an exemplary bumper of the hammer drill.

A further embodiment of the percussion mechanism 6 envisages providing the striker 14 with a rotationally symmetrical radial surface 53 of the push rod 39 (FIG. 8). In this case, the inner surface 54 of the bumper 19 is asymmetrical to the working axis 10. By way of example, the rubber ring 55 has a larger inside cross-section 56 in one place.

The invention claimed is:

1. A hand-held power tool, comprising:

a tool receptacle for holding a chiseling tool; and a pneumatic percussion mechanism including a striker for applying impacts in an impact direction to the chiseling tool, a motor-driven exciter, wherein the striker is coupled by an air spring to reciprocating movement of the exciter, and a guide tube which the striker abuts when guided along a working axis;

wherein the striker is guided during a movement between an impact position and the exciter with a guide length on the guide tube, wherein the guide length is reduced if the impact position is exceeded in the impact direction, and wherein the striker is guided with a sloped guide after exceeding the impact position and which inclines the striker relative to the working axis;

wherein the sloped guide has a radial inner surface facing the working axis, wherein the striker has a radial surface in contact with the inner surface, and wherein one of the radial inner surface and the radial surface is configured asymmetrically to the working axis;

wherein the radial inner surface or the radial surface has a projection protruding in a radial direction in only one angular direction.

2. The hand-held power tool according to claim 1 further comprising venting ports, wherein the air spring is ventable by the venting ports, and wherein the venting ports are only opened when the striker moves in the impact direction beyond the impact position.

3. The hand-held power tool according to claim 1, wherein the striker has a piston guided by the guide tube and a push rod forming an impact surface, wherein the sloped guide guides the push rod.

4. The hand-held power tool according to claim 3, wherein the push rod has a radial surface configured asymmetrically to an axis of the piston.

5. A hand-held power tool, comprising:

a tool receptacle for holding a chiseling tool; and a pneumatic percussion mechanism including a striker for applying impacts in an impact direction to the chiseling tool and a motor-driven exciter, wherein the striker is coupled by an air spring to reciprocating movement of the exciter;

wherein, if an impact position is exceeded by the striker in the impact direction, the striker is guided with a sloped guide which inclines the striker relative to a working axis;

wherein the sloped guide has a radial inner surface facing the working axis, wherein the striker has a radial surface in contact with the inner surface, and wherein one of the radial inner surface and the radial surface is configured asymmetrically to the working axis;

wherein the radial inner surface or the radial surface has a projection protruding in a radial direction in only one angular direction.

* * * * *